US005533427A

United States Patent [19]

Chow

[11] Patent Number: 5,533,427

[45] Date of Patent: Jul. 9, 1996

[54] RATCHET WRENCH HAVING RATCHET TEETH OF HIGHER STRENGTH

[76] Inventor: Jessie Chow, No. 18 Hou Juan Road, Taichung, Taiwan

[21] Appl. No.: 415,428

[22] Filed: Apr. 3, 1995

[51] Int. Cl.[6] ..... B25B 13/46

[52] U.S. Cl. ..... 81/63.2; 81/63; 81/60; 192/43; 192/46

[58] Field of Search ..... 81/63.1, 62, 60, 81/43, 43.1, 43.2, 63.2, 63, 61; 192/46, 82.1; 188/82.2

[56] References Cited

U.S. PATENT DOCUMENTS

| | | | |
|---|---|---|---|
| 983,562 | 2/1911 | Murray | 81/63 |
| 3,265,171 | 8/1966 | Kilness | 192/43.2 |
| 4,485,700 | 12/1984 | Colvin | 81/62 |
| 4,561,329 | 12/1985 | Lack | 81/62 |
| 5,178,047 | 1/1993 | Arnold et al. | 81/62 |
| 5,255,576 | 10/1993 | Keith | 81/63.2 |
| 5,404,773 | 4/1995 | Norville | 81/63.1 |

*Primary Examiner*—Bruce M. Kisliuk
*Assistant Examiner*—Joni B. Danganan
*Attorney, Agent, or Firm*—Charles E. Baxley

[57] ABSTRACT

A ratchet wrench includes a ratchet wheel and a pawl engaged in a head portion. The ratchet wheel includes a number of curved and concave teeth formed in the outer peripheral surface, and the pawl includes a number of curved and convex teeth for engaging with the curved and concave teeth of the ratchet wheel so as to strengthen the engagement between the teeth. In addition, the teeth of the pawl are all engaged with the teeth of the ratchet wheel such that the engagement between the ratchet wheel and the pawl is further strengthened.

7 Claims, 3 Drawing Sheets

RATCHET WRENCH HAVING RATCHET TEETH OF HIGHER STRENGTH

BACKGROUND OF THE INVENTION

1. Field of the Invention

The present invention relates to a ratchet wrench, and more particularly to a ratchet wrench having ratchet teeth of higher strength.

2. Description of the Prior Art

Various kinds of ratchet wrenches have been known and used for many years. The typical ratchet wrenches comprise a ratchet wheel rotatably engaged in the head portion of the ratchet wrench and including a cylindrical outer peripheral surface having a number of teeth formed thereon. The teeth include a straight configuration. The ratchet wrench further includes a pawl rotatably provided beside the ratchet wheel and having two ends each including one or two teeth formed thereon for selectively engaging with the teeth of the ratchet wheel so as to control the acting directions of the ratchet wrench. In the typical ratchet wrench, the pawl includes only one or two teeth engaged with the teeth of the ratchet wheel only such that the engagement between the pawl and the ratchet wheel is not strong enough.

The present invention has arisen to mitigate and/or obviate the afore-described disadvantages of the conventional ratchet wrenches.

SUMMARY OF THE INVENTION

The primary objective of the present invention is to provide a ratchet wrench having ratchet teeth of higher strength.

The other objective of the present invention is to provide a ratchet wrench which includes a pawl having a number of teeth engaged with the ratchet wheel simultaneously.

In accordance with one aspect of the invention, there is provided a ratchet wrench comprising a handle portion, a head portion including a first cavity and a second cavity formed therein and partially overlapping each other, a ratchet wheel rotatably engaged in the first cavity and including an outer peripheral surface having a curved and concave configuration and having a plurality of first teeth formed thereon, the ratchet wheel rotatable about an axis the first teeth including a curved and concave configuration, the outer peripheral surface and the first teeth being curved radially inward toward the axis, the curve having a tangent at the closest point to the axis being parallel to the axis and a pawl means engaged in the second cavity and including a plurality of second teeth for selectively engaging with the first teeth of the ratchet wheel so as to control rotational direction of the ratchet wheel, the second teeth including a curved and convex configuration for engaging with the first teeth of curved and concave configuration so as to strengthen an engagement between the first teeth and the second teeth.

In accordance with another aspect of the invention, there is provided a ratchet wrench comprising a handle portion, a head portion including a first cavity and a second cavity formed therein and partially overlapping each other, the second cavity including two end portions, a ratchet wheel rotatably engaged in the first cavity and including an outer peripheral surface having a plurality of first teeth formed thereon, the ratchet wheel being rotatable in a first direction and a second direction relative to the head portion, a pawl means engaged in the second cavity and movable between the end portions of the second cavity, the pawl means including a plurality of second teeth for engaging with the first teeth of the ratchet wheel so as to control rotational direction of the ratchet wheel, and an actuating means for moving the pawl means to either of the end portions of the second cavity. The ratchet wheel is rotated in the first direction when the pawl means is engaged in a first of the end portions of the second cavity and when the head portion is rotated in the first direction, the head portion is rotated freely relative to the ratchet wheel when the pawl means is engaged in the first end portion of the second cavity and when the head portion is rotated in the second direction. The ratchet wheel is rotated in the second direction when the pawl means is engaged in a second of the end portions of the second cavity and when the head portion is rotated in the second direction, the head portion is rotated freely relative to the ratchet wheel when the pawl means is engaged in the second end portion of the second cavity and when the head portion is rotated in the first direction. The teeth of the pawl are all engaged with the teeth of the ratchet wheel.

A knob means is rotatably engaged in the head portion, the actuating means is secured to the knob means and rotated in concert with the knob means, and the knob means includes an extension for engaging with the pawl means and for moving the pawl means between the end portions of the second cavity.

The head portion includes an upper surface having a circular opening and a puncture formed therein, the head portion includes an aperture formed between and communicating the first cavity with the circular opening, the knob means is rotatably engaged in the circular opening and includes a stud rotatably engaged in the puncture, the actuating means includes a ring portion for engaging with and for securing to the stud.

The pawl means includes a key means for engaging with the aperture for limiting rotational movement of the knob means.

The head portion includes a bottom surface, the stud includes a pair of depressions formed therein, the puncture includes a wall member having a blind-ended hole formed therein proximate to the handle portion and angled upwardly from the bottom surface of the head portion and directed toward the handle portion, the head portion further includes a detent means having a spring and a ball engaged in the blind-ended hole, the ball extends slightly outward of the blind-ended hole for engaging with the depressions of the stud.

The pawl means includes an upper portion having two stops formed thereon so as to define a gap therebetween, the extension of the actuating means is engaged in the gap for engaging with the stops so as to move the pawl means toward either of the end portions of the second cavity.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
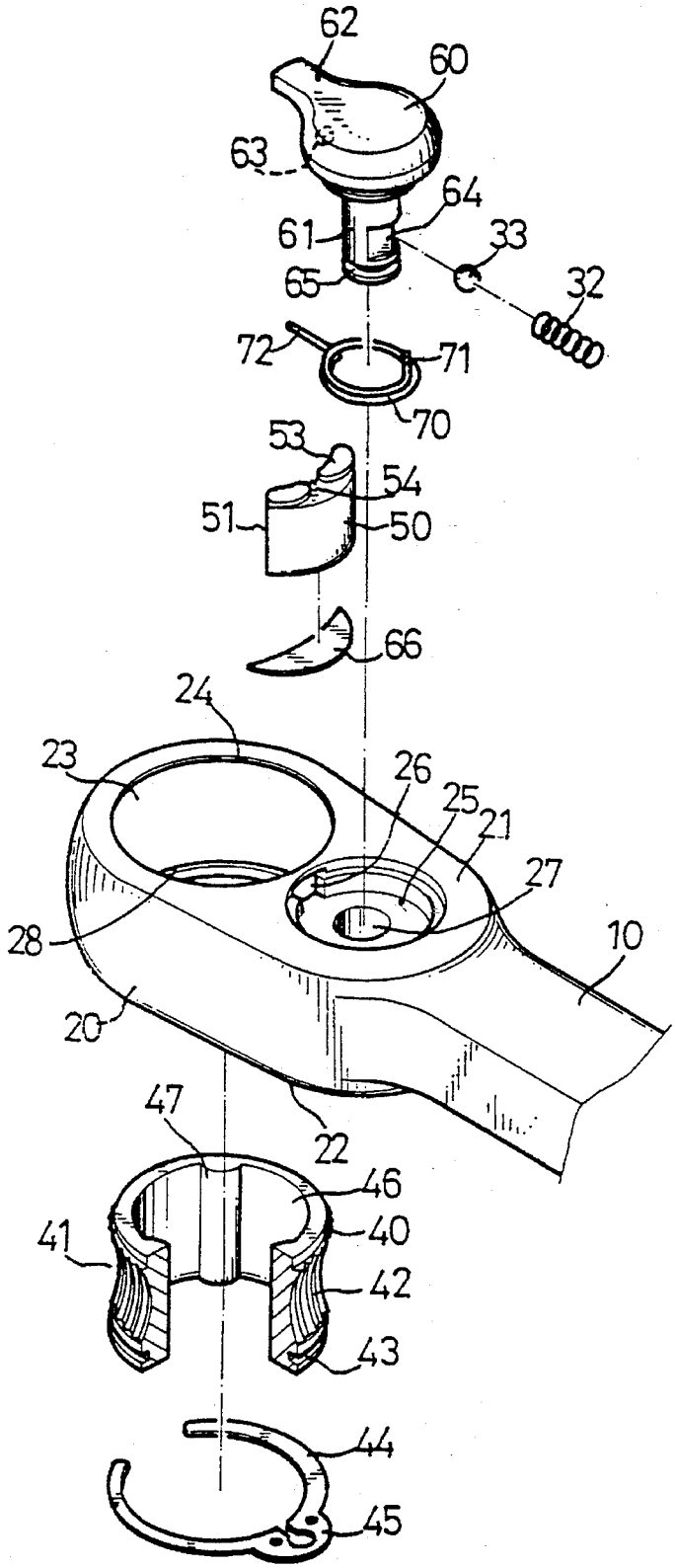
FIG. 1 is an exploded view of a ratchet wrench in accordance with the present invention.
Figure 2:
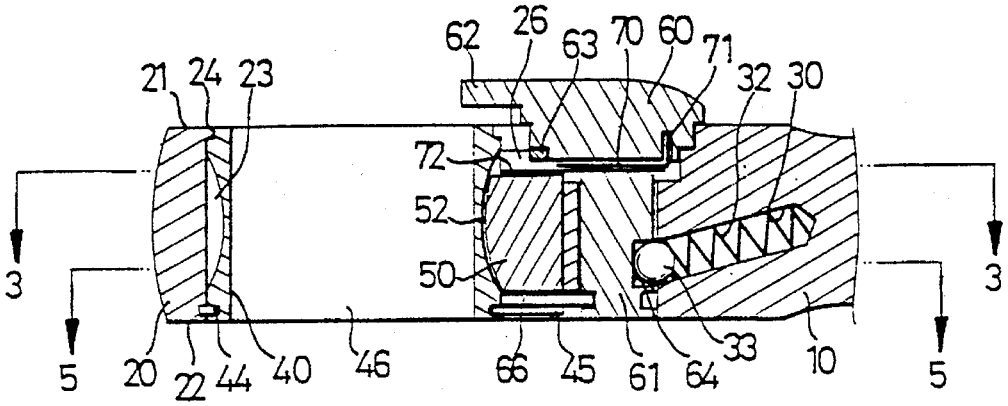
FIG. 2 is a cross sectional view taken along lines 2—2 of FIG. 3.

Referring to the drawings, and initially to FIGS. 1 and 2, a ratchet wrench in accordance with the present invention comprises a handle portion 10 and a head portion 20. The head portion 20 includes an upper surface 21 and a bottom surface 22. A circular cavity 23 is formed from the bottom surface 22 of the head portion 20 and extended inward of the head portion 20. The circular cavity 23 has a center having an axis through the center thereof. An annular flange 24 extends radially inward of the upper portion of the cavity 23. A circular opening 25 is formed in the upper surface 21 of the head portion 20 and spaced apart from the circular cavity 23 and includes a center axis. An aperture 26 is formed between and communicating the circular cavity 23 and the circular opening 25. A puncture 27 is formed in the head portion 20 and is communicating with the circular opening 25. An annular groove 28 is formed in the bottom portion of the wall of the circular cavity 23. The head 20 further includes a substantially semi-circular cavity 29 (FIGS. 3 and 4) formed from the bottom surface 22 of the head portion 20 and extended inward of the head portion 20. The semi-circular cavity 29 is communicating with the circular cavity 23.

A blind-ended hole 30 is formed in the wall of the puncture 27 proximate to the handle portion 10 and is preferably angled upwardly from the bottom surface 22 of the head portion 20 and directed toward the handle portion 10 for receiving a detent means which includes a spring 32 and a ball 33, best shown in FIG. 2. The ball 33 extends slightly outward of the hole 30.

A ratchet wheel 40 which is substantially cylindrical is disposed in the circular cavity 23 and is engaged with the annular flange 24. The ratchet wheel 40 includes a concave outer peripheral surface 41 having a plurality of teeth 42 uniformly formed therein and spaced apart from each other such that the teeth 42 includes a concave and curved configuration. The ratchet wheel 40 includes an annular groove 43 formed in the bottom portion for engaging with a clamping ring 44 which is also engaged in the annular groove 28 of the head portion such that the ratchet wheel 40 may be rotatably engaged in the circular opening 23 and such that the ratchet wheel 40 is rotatable about the axis of the circular cavity 23. The clamping ring 44 includes an ear 45 extended therefrom and extended toward the handle portion 10. The ratchet wheel 40 includes a bore 46 for receiving the fastening members such as bolts, screws, nuts etc., and includes a number of ribs 47 radially projected inwards of the bore 46 for engaging with the fastening members so as to drive the fastening members.

Figure 3:
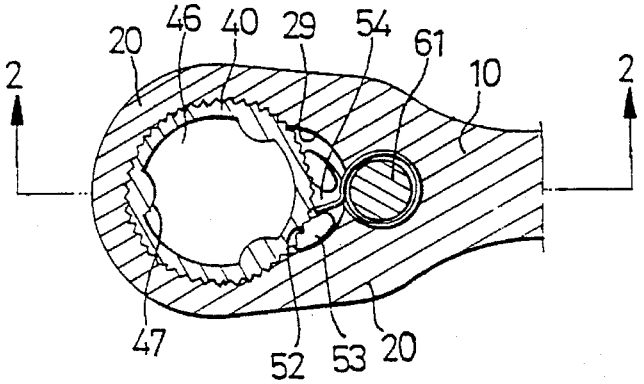
FIGS. 3 and 4 are cross sectional views taken along lines 3—3 of FIG. 2 with the pawl in different positions.
Figure 4:
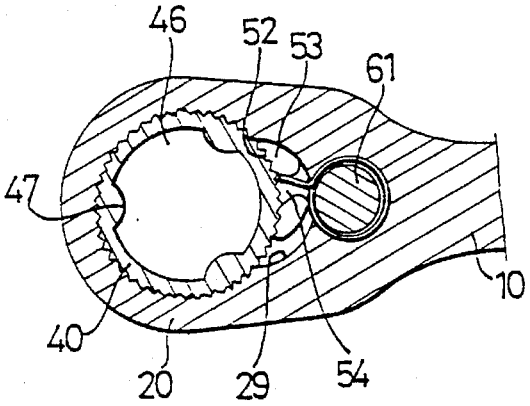

A pawl 50 is engaged in the semi-circular cavity 29 and includes one surface 51 formed with a plurality of uniformly spaced-apart teeth 52 for engaging with the teeth 42 of the ratchet wheel 40. The teeth 52 include a convex configuration for engaging with the curved and concave teeth 42 of the ratchet wheel 40, best shown in FIGS. 2 to 4. The pawl 50 includes two stops 53 formed on top thereof so as to define a gap 54 therebetween. The pawl 50 has a size slightly smaller than that of the semi-circular cavity 29 such that the pawl 50 may move from one end to the other of the semi-circular cavity 29, best shown in FIGS. 3 and 4. When the pawl 50 is located in one end of the cavity 29 as shown in FIG. 3 and when the handle portion 10 is rotated counterclockwise relative to the ratchet wheel 40, the ratchet wheel 40 may be caused to rotate counterclockwise by the pawl 50 which is engaged between the ratchet wheel 40 and the head portion 20. When the handle portion 10 is rotated clockwise, the pawl 50 may have a tendency to move toward the other end of the cavity 29 and will not be engaged between the ratchet wheel 40 and the head portion 20. On the contrary, when the pawl 50 is engaged in the other end of the cavity 29 as shown in FIG. 4, the ratchet wheel 40 may be rotated clockwise by the handle portion 10 when the handle portion 10 is rotated clockwise. The handle 10 may freely rotate counterclockwise relative to the ratchet wheel 40 at this moment.

Figure 5:
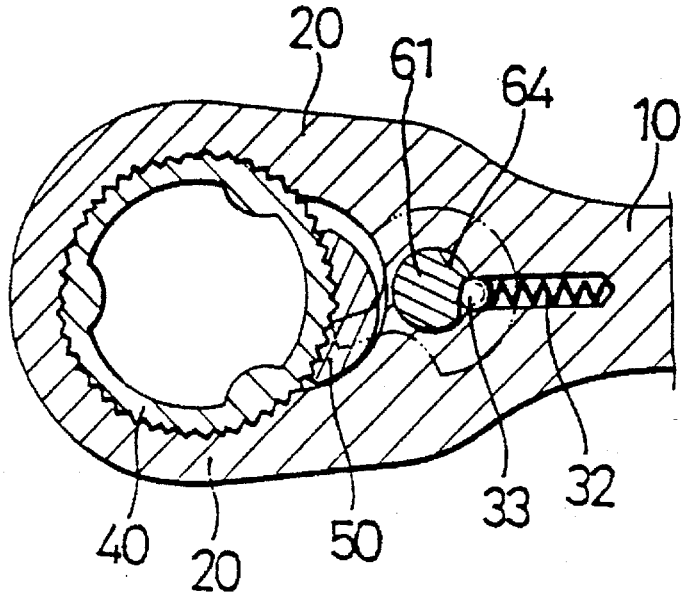
FIG. 5 is a cross sectional view taken along lines 5—5 of FIG. 2.
Figure 6:
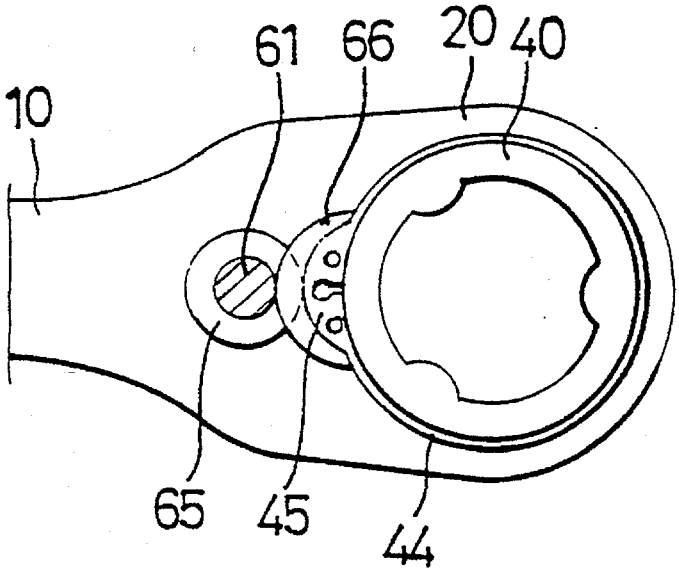
FIG. 6 is a bottom schematic view illustrating the assembling of the ratchet wrench.

A knob means 60 includes a stud 61 rotatably engaged in the puncture 27, includes a hand grip 62 for rotating the knob means 60 and includes a key 63 for engaging with the aperture 26 so as to limit the rotational movement of the knob means 60. The stud 61 includes a pair of spaced-apart depressions 64 for selectively engaging with the ball 33, best shown in FIG. 5. The stud 61 includes an annular slot 65 formed in the bottom portion for engaging with a retaining plate 66 which is also engaged with the bottom surface of the pawl 50.

An actuating means 70 includes a ring portion for engaging with the stud 61 and includes one end 71 secured to the knob means 60 and includes the other end having an extension 72 extended into the gap 54 formed between the stops 53 of the pawl 50. The extension 72 of the actuating means 70 may move the pawl 50 toward either end of the cavity 29 when the actuating means 70 is rotated by the knob means 60 and when the ball 33 is engaged with either of the depressions 64 of the stud 61.

It is to be noted that the pawl 50 may be moved toward either end of the cavity 29 for engaging with the ratchet wheel 40 and for controlling the rotational directions of the ratchet wheel 40. All of the teeth 52 of the pawl 50 may engage with the teeth 42 of the ratchet wheel 40 such that the engagement between the pawl 50 and the ratchet wheel 40 can be greatly strengthened. In addition, the teeth 42 of the ratchet wheel 40 include a curved and concave configuration and the teeth 52 of the pawl 50 include a curved and convex configuration such that the engaging surfaces between the teeth 42, 52 are slightly increased. The increased engaging surfaces may further strengthen the engagement between the teeth 42, 52.

Accordingly, the ratchet wrench in accordance with the present invention includes a ratchet wheel and a pawl having a number of curved teeth engaged with each other so as to increase the strength of the engagement between the teeth. In addition, the teeth of the pawl are all engaged with the teeth of the ratchet wheel simultaneously such that the engagement between the ratchet wheel and the pawl is further strengthened.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a handle portion, a head portion including a first cavity and a second cavity formed therein and partially overlapping each other, a ratchet wheel rotatably engaged in said first cavity and including an outer peripheral surface having a curved and concave configuration and having a plurality of first teeth formed thereon, wherein said ratchet wheel rotates about an axis, said first teeth including a curved and concave configuration, said outer peripheral surface and said first teeth being curved radially inward, and toward said axis, and said curve having a tangent at the closest point to said axis being parallel to said axis a pawl means engaged in said second cavity and including a plurality of second teeth for selectively engaging with said first teeth of said ratchet wheel so as to control rotational direction of said ratchet wheel, said second teeth including a curved and convex configuration and curved radially outward for engaging with said first teeth of curved and concave configuration so as to strengthen an engagement between said first teeth and said second teeth.

2. A ratchet wrench comprising:

a handle portion, a head portion including a first cavity and a second cavity formed therein and partially overlapping each other, said second cavity including two end portions, a ratchet wheel rotatably engaged in said first cavity and including an outer peripheral surface having a plurality of first teeth formed thereon, wherein said ratchet wheel rotates about an axis, said ratchet wheel being rotatable in a first direction and a second direction relative to said head portion, said first teeth including a curved and concave configuration, said outer peripheral surface and said first teeth being curved radially inward toward said axis, and said curve having a tangent at the closest point to said axis being parallel to said axis, a pawl means engaged in said second cavity and movable between said end portions of said second cavity, said pawl means including a plurality of second teeth for engaging with said first teeth of said ratchet wheel so as to control rotational direction of said ratchet wheel, said second teeth including a curved and convex configuration and curved radially outward for engaging with said radially inwardly curved first teeth, and an actuating means for moving said pawl means to either of said end portions of said second cavity, said ratchet wheel being rotated in said first direction when said pawl means is engaged in a first of said end portions of said second cavity and when said head portion is rotated in said first direction, said head portion being rotated freely relative to said ratchet wheel when said pawl means is engaged in said first end portion of said second cavity and when said head portion is rotated in said second direction; said ratchet wheel being rotated in said second direction when said pawl means is engaged in a second of said end portions of said second cavity and when said head portion is rotated in said second direction, said head portion being rotated freely relative to said ratchet wheel when said pawl means is engaged in said second end portion of said second cavity and when said head portion is rotated in said first direction.

3. A reversible ratchet wrench according to claim 2 further comprising a knob means rotatably engaged in said head portion, said actuating means being secured to said knob means and rotated in concert with said knob means, and said actuating means including an extension for engaging with said pawl means and for moving said pawl means between said end portions of said second cavity.

4. A reversible ratchet wrench according to claim 3, wherein said head portion includes an upper surface having a circular opening and a puncture formed therein, said head portion includes an aperture formed between and communicating said first cavity with said circular opening, said knob means is rotatably engaged in said circular opening and includes a stud rotatably engaged in said puncture, said actuating means includes a ring portion for engaging with and for securing to said stud.

5. A reversible ratchet wrench according to claim 4, wherein said knob means includes a key means for engaging with said aperture for limiting rotational movement of said knob means.

6. A reversible ratchet wrench according to claim 4, wherein said head portion includes a bottom surface, said stud includes a pair of depressions formed therein, said puncture includes a wall member having a blind-ended hole formed therein proximate to said handle portion and angled upwardly from said bottom surface of said head portion and directed toward said handle portion, said head portion further includes a detent means having a spring and a ball engaged in said blind-ended hole, said ball extends slightly outward of said blind-ended hole for engaging with said depressions of said stud.

7. A reversible ratchet wrench according to claim 3, wherein said pawl means includes an upper portion having two stops formed thereon so as to define a gap therebetween, said extension of said actuating means is engaged in said gap for engaging with said stops so as to move said pawl means toward either of said end portions of said second cavity.

* * * * *